United States Patent [19]

Komoda et al.

[11] Patent Number: 4,500,400

[45] Date of Patent: Feb. 19, 1985

[54] COUNTER FLOW DEVICE FOR ELECTROPLATING APPARATUS

[75] Inventors: Akira Komoda; Yasuhiro Hirooka; Takahisa Yoshihara; Akira Matsuda, all of Chiba, Japan

[73] Assignee: Kawasaki Steel Corporation, Kobe, Japan

[21] Appl. No.: 627,394

[22] Filed: Jul. 3, 1984

[30] Foreign Application Priority Data

Oct. 7, 1983 [JP] Japan ..... 58-186883

[51] Int. Cl.[3] ..... C25D 17/00

[52] U.S. Cl. ..... 204/206

[58] Field of Search ..... 204/206–211

[56] References Cited

U.S. PATENT DOCUMENTS 3,483,098 12/1969 Kramer ..... 204/206
3,634,223 1/1972 Carter ..... 204/206
3,855,108 12/1974 Bolz ..... 204/206

FOREIGN PATENT DOCUMENTS 56-142893 11/1981 Japan .

*Primary Examiner*—Thomas Tufariello
*Attorney, Agent, or Firm*—Balogh, Osann, Kramer, Dvorak, Genova & Traub

[57] ABSTRACT

A counter flow device for a plating apparatus including a rotary drum with its substantially half part immersed in a plating solution in a plating bath, about which a metallic strip to be plated passes in synchronism with rotation of said rotary drum and anodes spaced apart by radial gaps from the strip for causing electric current to flow between the strip and the anodes. According to the invention the counter flow device comprises a bottom nozzle arranged at a bottom of the bath and directing in a direction substantially opposite to an entering direction of the strip thereat and a top nozzle having a nozzle opening whose tip end is immersed in the proximity of a surface of the plating solution at a location where the strip leaves the plating solution, thereby ensuring uniform counter flows over entire gaps between the metallic strip and anodes to remarkably increase critical current density in plating and advantageously realize uniform plating.

9 Claims, 20 Drawing Figures

COUNTER FLOW DEVICE FOR ELECTROPLATING APPARATUS

BACKGROUND OF THE INVENTION

1. Field of the Invention

This invention relates to a counter flow device for an electroplating apparatus for metallic strips, and more particularly to a counter flow device for an electroplating apparatus having a radial cell type plating bath or tank capable of high current density plating the metallic strips running through the bath at low speeds.

2. Description of the Prior Art

A radial cell type plating apparatus includes a large diameter rotary drum for current flow with its substantially half part immersed in a plating solution or electrolyte. A metal strip is brought into contact with a substantially half circumference of the drum and passes thereabout in synchronism with the rotation of the drum during which electric current is caused to flow through the plating solution between the strip and an anode spaced apart therefrom by a radial current flow gap.

Such a plating apparatus is advantageously used to plate only one surface of a strip owing to its inherent construction and permits a distance between the strip and an anode to be possibly small so as to avoid superfluous consumption of the plating electric power, thereby enabling high speed plating with high power to be effected.

In such an electroplating system, there are generally two cases, one using insoluble electrodes as anodes, and the other using soluble electrodes consisting mainly of a metal the same as a plating metal. Particularly, the latter case using the soluble electrodes has advantages in that the plating metal is easily replenished and gas evolved from the electrode surfaces is little, so that it is suitable for obtaining thick plating layers with high power.

In this plating system hitherto used, as schematically shown in FIGS. 1*a* and 1*b*, a plating solution or electrolyte is jetted upward from an inlet 2' at the bottom of a plating tank 2 toward a rotary drum 3 against a strip 1 so as to be supplied into clearances between a metallic strip 1 and a pair of anodes 5. The metallic strip 1 is in contact with an outer circumference of the rotary drum 3 and carried along with the rotating drum 3. The pair of anodes 5 are arcuate in section and arranged side by side in a moving direction of the strip and in opposition to a lower half circumference of the drum 3.

Accordingly, the plating solution flows against the movement of the strip on the entrance side of the strip (referred to hereinafter "downpass") but flows in the same direction as the movement of the strip on the exit side of the strip (referred to hereinafter "uppass").

It has been regarded that high current density in electroplating is preferable because required plating is obtained at a higher plating speed or in a smaller plating apparatus. When the current density is too high beyond a limit value, however, treelike electric deposits often occur on surfaces of metallic strips and in particularly, defects are frequently caused in edges of the strips called "scorching" or "black edge" due to the excess concentration of electric current.

Such a critical current density varies with plating conditions such as compositions and temperatures of the plating solution, among which relative speeds between the strips and the plating solutions greatly affect the critical current density.

In the radial cell type plating bath or tank of the prior art as shown in FIG. 1, therefore, the relative speed between the metallic strip and the plating solution becomes much smaller in the above mentioned "uppass" where the strip and plating solution move in the same direction, particularly with a low moving speed of the strip, to cause the critical current density to be much smaller, whereby there is a great tendency to cause the "scorching" in the edges of the strips. As shown in FIG. 2 illustrating one example of the relation between the critical current density and the speed of metallic strip, even under conditions good for plating in the "downpass", the "scorching" occurred in the "uppass". It was therefore required to decrease all the supply current and to lower the speed of metallic strip in order to avoid the "scorching". In other words, it could not help doing a disadvantageous operation for plating the metallic strip.

Recently, moreover, the requirement for the corrosion resistance has become severer and various kinds of alloy plating instead of hitherto used single metal plating have been put into practical use. It has been studied for plating to use for example not only binary alloys such as Zn-Ni, Zn-Fe and the like but also multiple metal alloys such as Zn-Ni-Co, Zn-Ni-Cr and the like.

In plating using these alloys, deposits of components of the alloys are delicately affected by plating conditions. In other words, the variation in current density and flowing speed of electrolyte greatly affects compositions of the plating alloys. Referring to FIG. 3*a* illustrating one example of Zn and Fe distributions in Zn-Fe alloy plating layer by IMMA plated by the hitherto used radial cell type plating apparatus, it is recognized that the contents of Fe and Zn considerably varies in a direction of thickness or depth. In this case, it has been experienced that sometimes unstable black stripe patterns occur on the surfaces of the strips probably caused by irregular flow velocity of the electrolyte, which considerably spoil the appearance of the metallic strips.

SUMMARY OF THE INVENTION

It is a primary object of the invention to provide a counter flow device for a radial cell type electroplating apparatus, which eliminates defects in plating layer caused by the prior art apparatus and ensures to obtain excellent plating layers even at a low running speed of a metallic strip so as to put the device to practical use.

The above object can be achieved by the counter flow device for a plating apparatus including a rotary drum with its substantially half part immersed in a plating solution in a bath, about said drum a metallic strip to be plated passing in synchronism with rotation of said rotary drum and anodes spaced apart by radial gaps from the strip for causing electric current to flow between said strip and the anodes, which device according to the invention comprises a bottom nozzle arranged at a bottom of the bath and having a nozzle opening directing in a direction substantially opposite to an entering direction of said strip thereat and a top nozzle having a nozzle opening whose tip end is immersed in the proximity of a surface of said plating solution at a location where the strip leaves the plating solution.

It is particularly preferable that the top and bottom nozzles are capable of jetting from the openings a plating solution at a linear speed of 0.2 to 2 m/sec between the strip and the anodes, and the top and bottom nozzles are arranged so as to permit their jetting direction of the plating solution to be inclined at an angle within 10° relative to tangents to the rotary drum thereat.

Moreover, an immersed depth of the tip end of the top nozzle in the plating solution should be more than 15 mm from a surface of the plating solution in a state of repose. As the jetted flow from the nozzle moves, the surface of the plating bath lowers from the surface of the plating solution in the state of repose by the order of 10 mm to include the air. To avoid this, the tip end of the top nozzle should be immersed into a depth more than 15 mm from the surface of the plating bath in the state of repose.

Furthermore, overlapped lengths of the top and bottom nozzles with edges of the anodes in moving directions of said strip are less than 10 mm for the top nozzle and less than 2 mm for the bottom nozzle. This feature is particularly important in a soluble anode radial cell plating apparatus having a plurality of anodes having arcuate cross-sections arranged on immersed bus bars so as to be able to radially move in accordance with consumption of the anodes.

With the above arrangement of the invention, a plating solution is forcedly circulated in current flow gaps between a metallic strip and arcuate electrodes in directions opposite to moving directions of the strip which are not only the entering direction of the strip into the plating solution but also the exit direction of the strip, thereby eliminating all the disadvantages in the prior art.

FIG. 3*b* illustrates the contents of Fe and Zn distributions by IMMA in Zn-Fe alloy plating layer plated with the aid of the counter flow device according to the invention. It is clearly evident from FIG. 3*b*, the distributions of Fe and Zn are considerably uniform according to the invention.

The invention will be more fully understood by referring to the following detailed specification and claims taken in connection with the appended drawings.

DETAILED DESCRIPTION OF THE PREFERRED EMBODIMENT

Figure 1A:
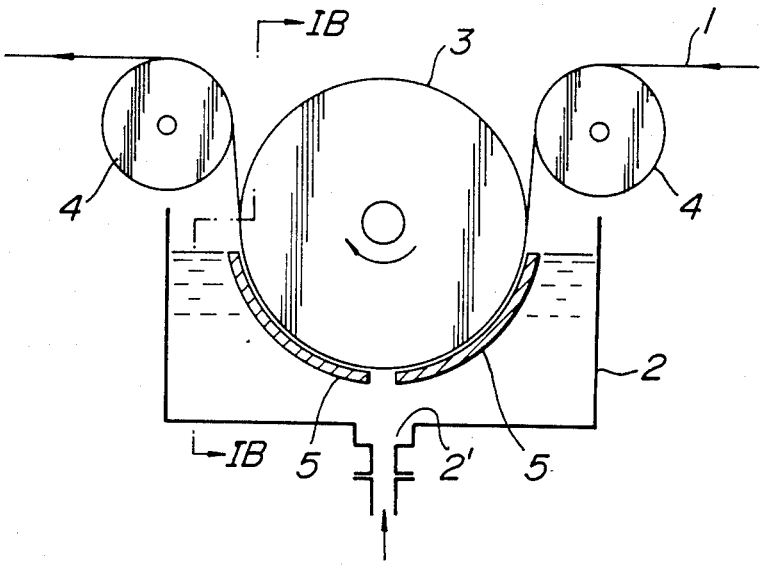
FIG. 1a PRIOR ART
FIG. 1*a* is a centrally sectional view of a radial cell type plating apparatus of the prior art.
Figure 1B:
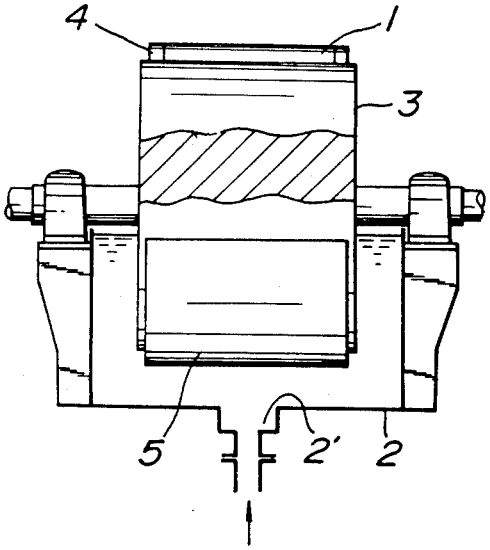
FIG. 1b PRIOR ART
FIG. 1*b* is a sectional view of the apparatus taken along lines IB—IB in FIG. 1*a*.
Figure 2:
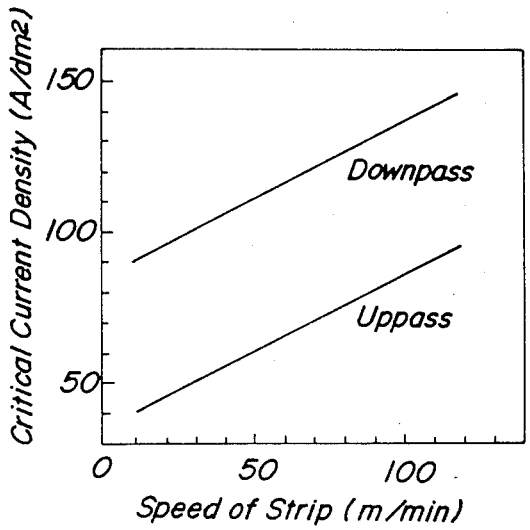
FIG. 2 is a graph in comparison of relations between critical current density and speed of metallic strip in downpass and uppass.
Figure 3A:
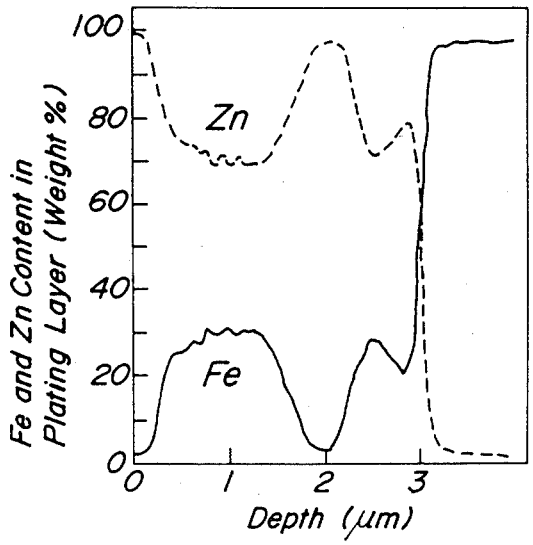
FIG.3a PRIOR ART
FIG. 3*a* illustrates Zn and Fe distributions in depth directions of Zn-Fe alloy plating layers plated by the prior art.
Figure 3B:
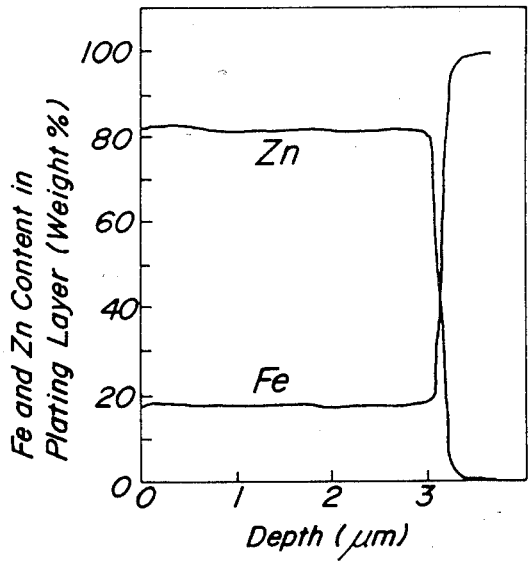
FIG. 3*b* illustrates Zn and Fe distributions of plating layers plated according to the invention.
Figure 4:
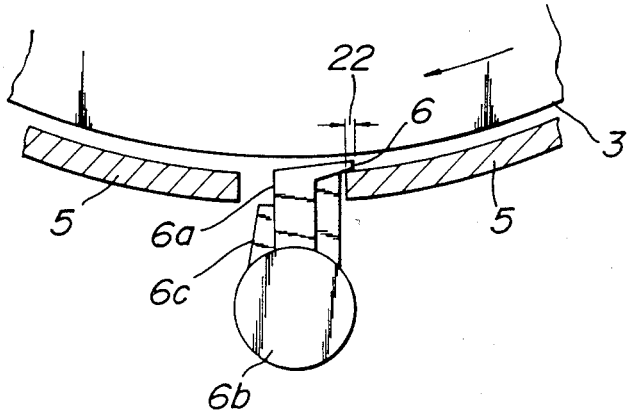
FIG. 4 illustrates an arrangement of a bottom nozzle according to the invention.
Figure 5:
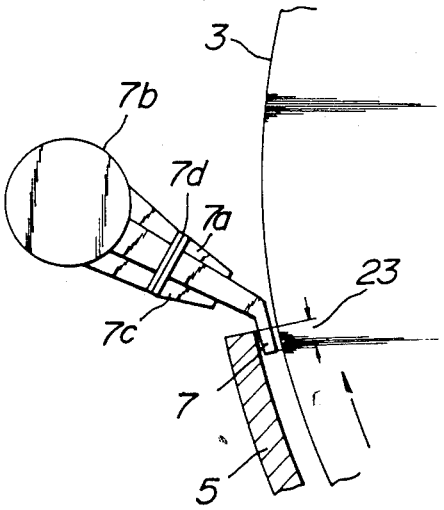
FIG. 5 illustrates an arrangement of a top nozzle according to the invention.
Figure 6A:
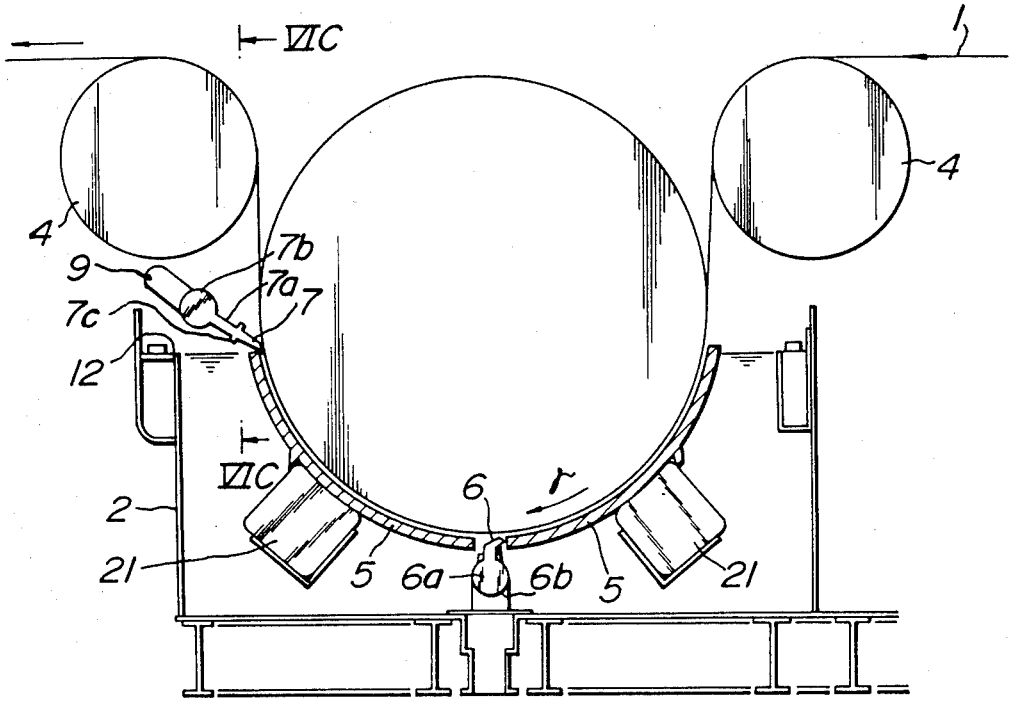
FIG. 6*a* is a sectional view of a radial cell type plating bath according to the invention taken along a moving direction of a strip.
Figure 6B:
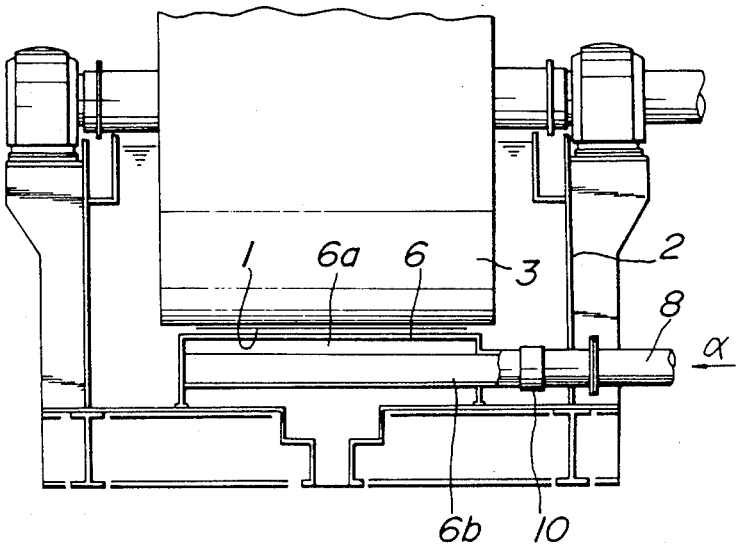
FIG. 6*b* is a sectional view of the bath in FIG. 6*a* taken along an axis of a drum.
Figure 6C:
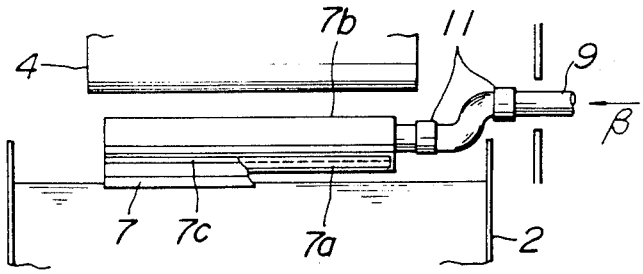
FIG. 6*c* is a sectional view of the bath taken along a line VIC—VIC in FIG. 6*a*.

FIGS. 4 and 5 illustrate respective examples of a bottom nozzle 6 and a top nozzle 7 according to the invention. FIGS. 6*a*, 6*b* and 6*c* explanatorily illustrate a radial cell type plating tank or bath provided with a counter flow device according to the invention whose circulating system is improved by employing the nozzles shown in FIGS. 4 and 5.

Each the nozzle 6 or 7 comprises a duct 6*a* or 7*a* having at its tip end an opening directing into a direction against a moving direction of a strip 1. The duct 6*a* or 7*a* communicates with a plenum chamber or header 6*b* or 7*b* connected to a pump for circulating a plating solution or electrolyte. A reference numeral 6*c* or 7*c* in the drawings denotes reinforcing ribs. The top nozzle 7 shown in FIG. 5 is an example of the nozzle having a coupling 7*d* for detachably mounting the nozzle.

In FIGS. 6*a*, 6*b* and 6*c*, the circulating plating solution or electrolyte is forced in directions shown by arrows $\alpha$ and $\beta$ into plating solution circulating pipings 8 and 9 having sleeve joints 10 and 11 to maintain a predetermined pressure in the headers 6*b* and 7*b*, thereby causing the plating solution from the openings of the bottom and top nozzles 6 and 7 to counterflow against the moving direction of the strip 1 shown by an arrow $\gamma$ in both the downpass and uppass of the strip 1. A surface level of the plating solution in the plating tank 2 is kept constant with the aid of an overflow weir 12 from which overflowing solution is introduced into the circulating pump.

Figure 7A:
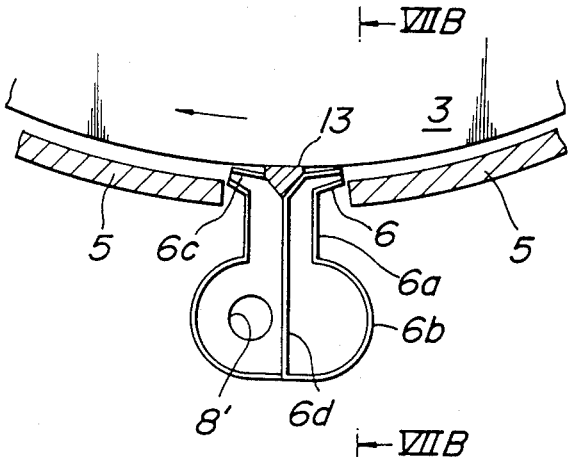
FIG. 7*a* is a partial sectional view illustrating a modification of a bottom nozzle according to the invention.
Figure 7B:
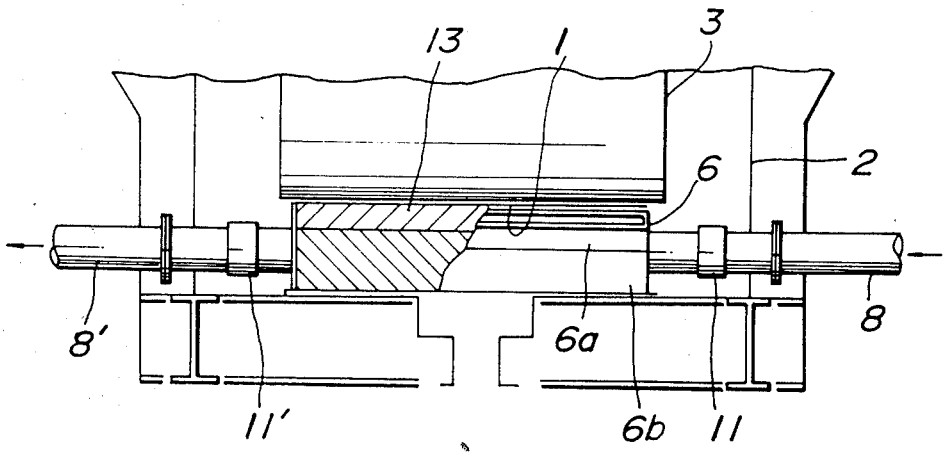
FIG. 7*b* is a sectional view taken along a line VIIB—VIIB in FIG. 7*a*.

FIGS. 7*a* and 7*b* illustrate a modification of the bottom nozzle 6, wherein refreshed plating solution is circulatively supplied into the downpass in the same manner as in the top nozzle 7 so as to prevent the solution passed through the uppass from mixing with the refreshed solution jetted from the bottom nozzle 6.

Namely, the duct 6*a* and the header 6*b* of the bottom nozzle 6 are divided by a partition 6*d* into upstream and downstream portions. The downsteam portion is formed along the uppass with a suction port 6*c* communicating with a return piping 8′ for exhausting the passed solution without mixing with the refreshed solution. A reference numeral 13 in FIGS. 7*a* and 7*b* denotes a separator which is a soft brush or a spongelike body and arranged at the top of said partition 6*d* and in close contact with the strip 1 between the uppass and the downpass.

The bottom nozzle 6 in this type serves to cause the plating solution to flow in the same manner as in the top nozzle 7 and also effectively serves to remove the gas particularly in the uppass, which would generate in large quantities when the anode 5 in an arcuate cross-section is insoluble.

Figure 8:
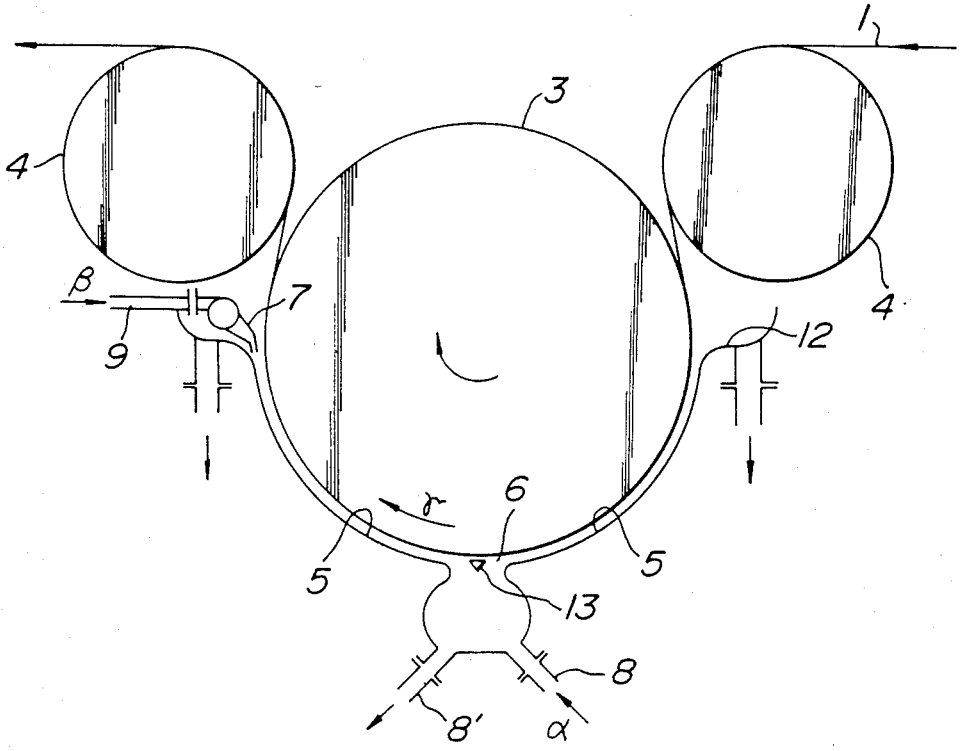
FIG. 8 illustrates a plating solution circulating system when using the bottom nozzle shown in FIG. 7.

FIG. 8 illustrates an outline of the operation of a radial cell type plating tank having the counter flow device using the bottom nozzle 6 explained in FIGS. 7*a* and 7*b*.

Figure 9:
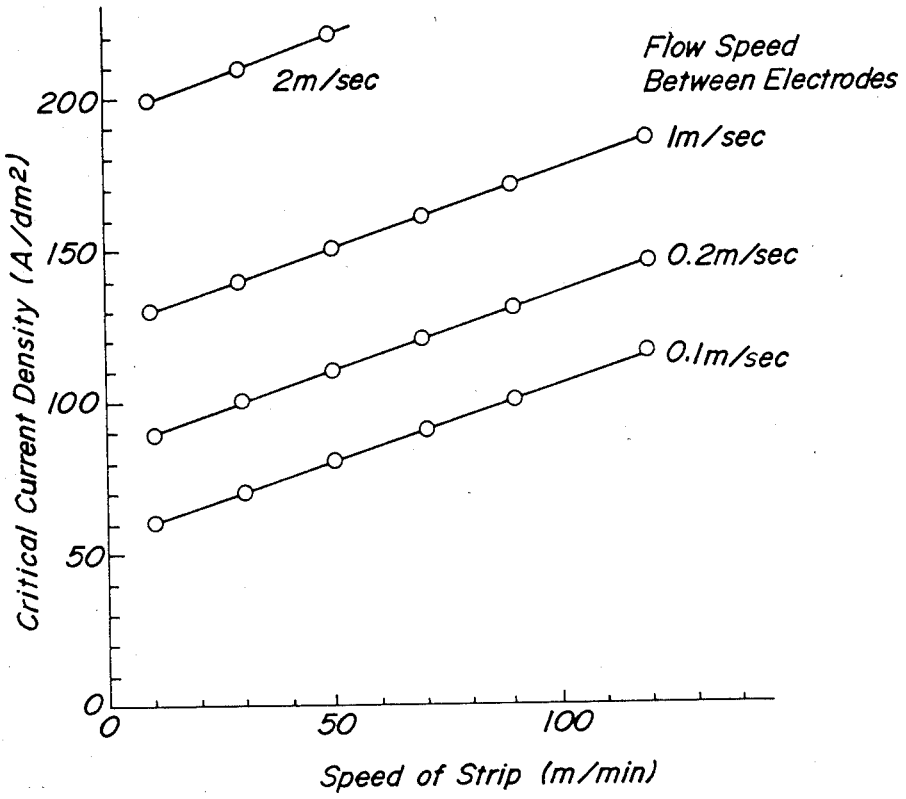
FIG. 9 is a graph illustrating relations between critical current density and speed of strips depending upon flow speeds of the plating solution between electrodes.

FIG. 9 illustrates the effect of the speed of strips on the critical current density ($A/dm^2$). In this experiment, a composition of the plating bath was a typical one, such as 200 g/l of $ZnCl_2$ and 300 g/l of KCl. The plating solution was supplied through the bottom and top nozzles 6 and 7 at flow speeds 0.1, 0.2, 1 and 2 m/sec at a temperature of 50° C. in the plating solution. As the axis of ordinate indicates the critical current density, areas above the respective lines of flow speeds of the plating solution as parameters indicate prohibitive zones where "scorching" tends to occur.

If the flow speed of the plating solution is lower than 0.2 m/sec, it cannot fulfil the requirement for effecting high efficiency plating with a higher current density. On the other hand, the circulating plating solution flowing at a speed higher than 2 m/sec requires a pump having an unduly large capacity which is disadvantageous in cost of installation. Therefore, the flow speed of the plating solution of 0.2–2 m/sec is preferable.

Then, Zn-Fe alloy plating aiming 20% Fe content was carried out to obtain 20 $g/m^2$ of plating layers under the following plating conditions.

Composition of plating bath: $ZnCl_2$ 200 g/l, KCl 300 g/l and $FeCl_2 \cdot 4H_2O$ 100 g/l Temperature of the bath: 50° C.

Current density: 100 $A/dm^2$

Figure 10:
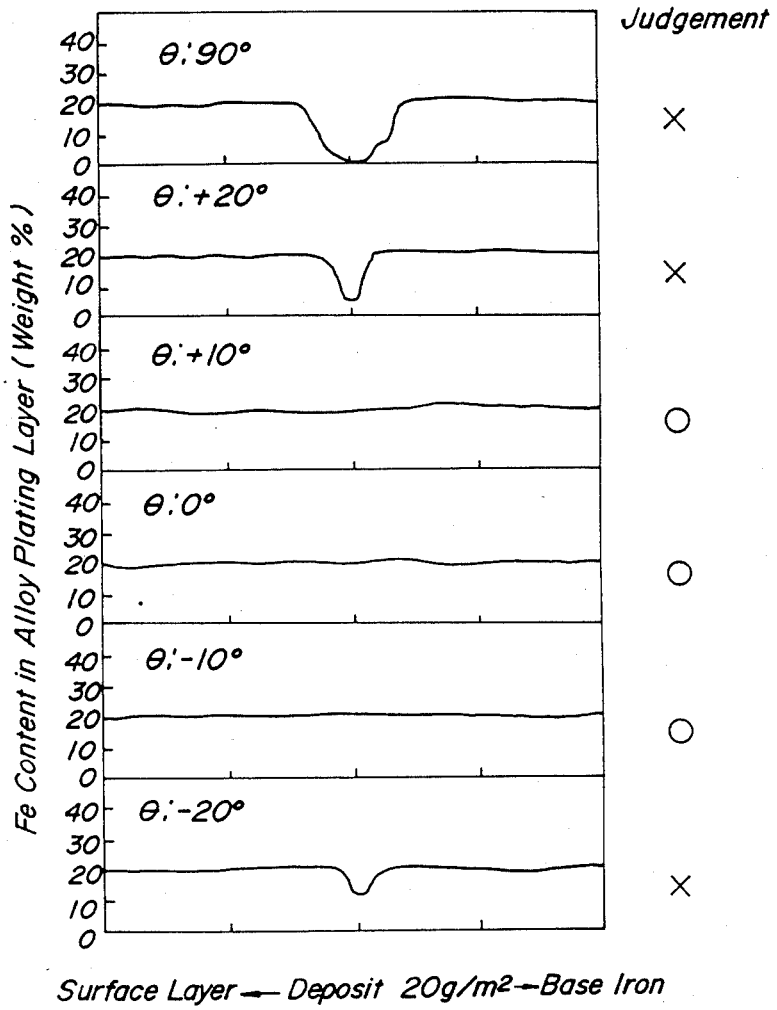
FIG. 10 is a comparative graph illustrating Fe distributions in depth directions of an alloy plating layer depending upon jetting angles $\theta$ of plating solution from nozzles.

The Fe content of the obtained alloy layer was measured in thickness directions in accordance with the IMMA. As can be seen from FIG. 10 illustrating the measured results, when jetting angles $\theta$ of plating solution at bottom and top nozzles 6 and 7 with respect to tangents to a rotary drum 3 thereat are more than $\pm 10°$, the Fe contents in alloy plating layers between surface layers and base irons remarkably decrease to below 20%, so that uniform alloy compositions cannot be obtained. In contrast herewith, with jetting angles within $\pm 10°$ substantially uniform alloy compositions can be obtained.

When soluble electrodes are used in either case, a plurality of anodes having arcuate cross-sections are in usual arranged on immersed bus bars 21 (FIG. 6*a*) located side by side on upstream and downstream sides of the bottom nozzle embraced therebetween and slightly oblique relative to generators of a rotary drum in a plating bath, thereby enabling the anodes to be radially moved in accordance with consumption of the anodes to keep the distance between the electrodes in a proper value. In this case, as the anodes having arcuate cross-sections are slightly inclined relative to a horizontal, if overlapped portions (refer to numerals 22 and 23 in FIGS. 4 and 5) of the tip ends of the nozzles and the anodes are too large, the parts of the anodes are shielded by the nozzles so as to obstruct the current flow therethrough to prevent the parts of the anodes from being resolved. Accordingly, these parts of the anodes remain insoluble, which are likely to accidentally contact the nozzles because they extend beyond normal anode surfaces. In a preferred embodiment of the invention, the overlapped lengths of the nozzles in moving directions of strips are less than 10 mm for top nozzles and less than 5 mm for bottom nozzles.

Moreover, the so-called basket system may be employed, which uses baskets mainly consisting of metal nets and accommodating therein a granular or lumpy soluble metal. In this case, as the baskets can be fixed, distances between electrodes need not be corrected. The baskets may be used as securing means for the top and bottom nozzles.

Figure 11A:
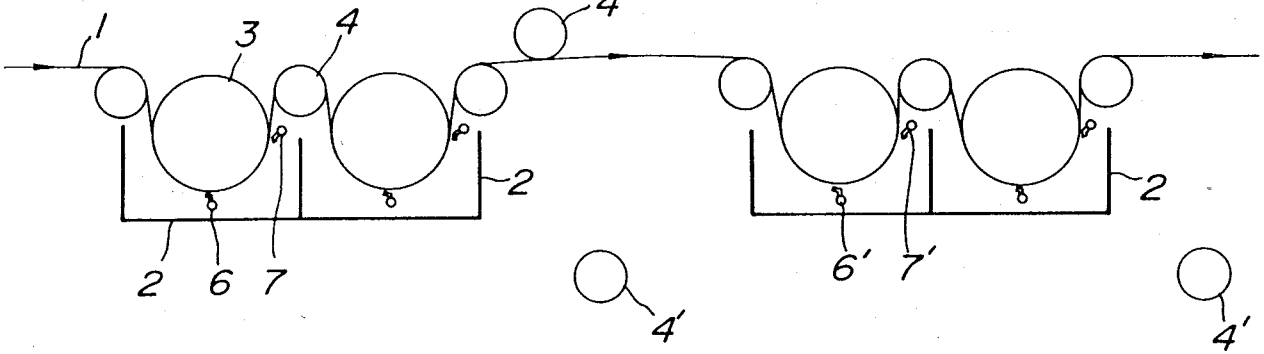
FIGS. 11*a* and 11*b* are schematic views for explaining switching over one surface and both surface platings.
Figure 11B:
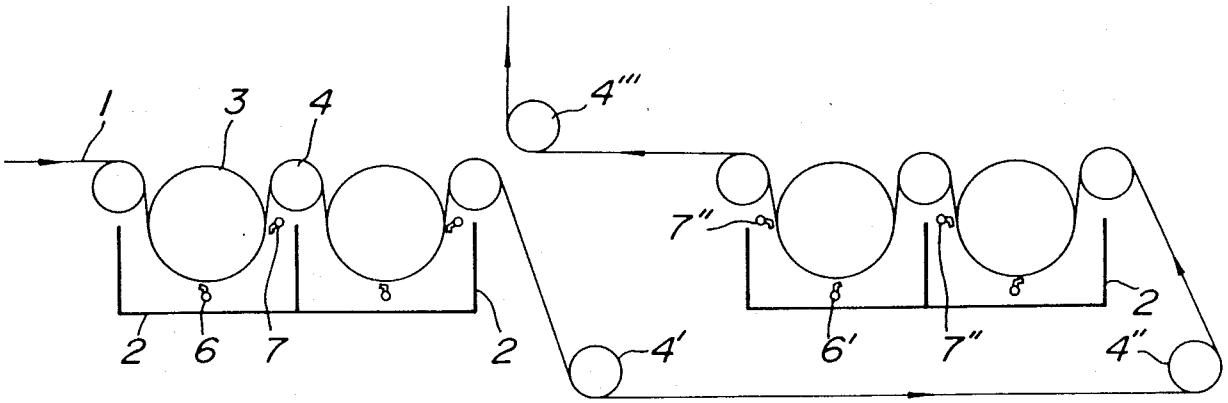

In plating using the above radial cell type plating bath, two baths are often used as a unit. Referring to FIGS. 11*a* and 11*b* are illustrating such an example, it is necessary to select either one surface plating in direct running as shown in FIG. 11*a* or both surface plating in roundabout running as shown in FIG. 11*b* with the aid of deflector rolls 4', 4'' and 4'''. In changing the one surface plating to the both surface plating, a moving direction of a strip is reversed in the plating bath 2 on downstream side, it is needed to reverse a jetting direction of the bottom nozzle 6' and to replace the top nozzle 7' to 7'' in FIG. 11*b*. Such changing operations are troublesome.

Figure 12:
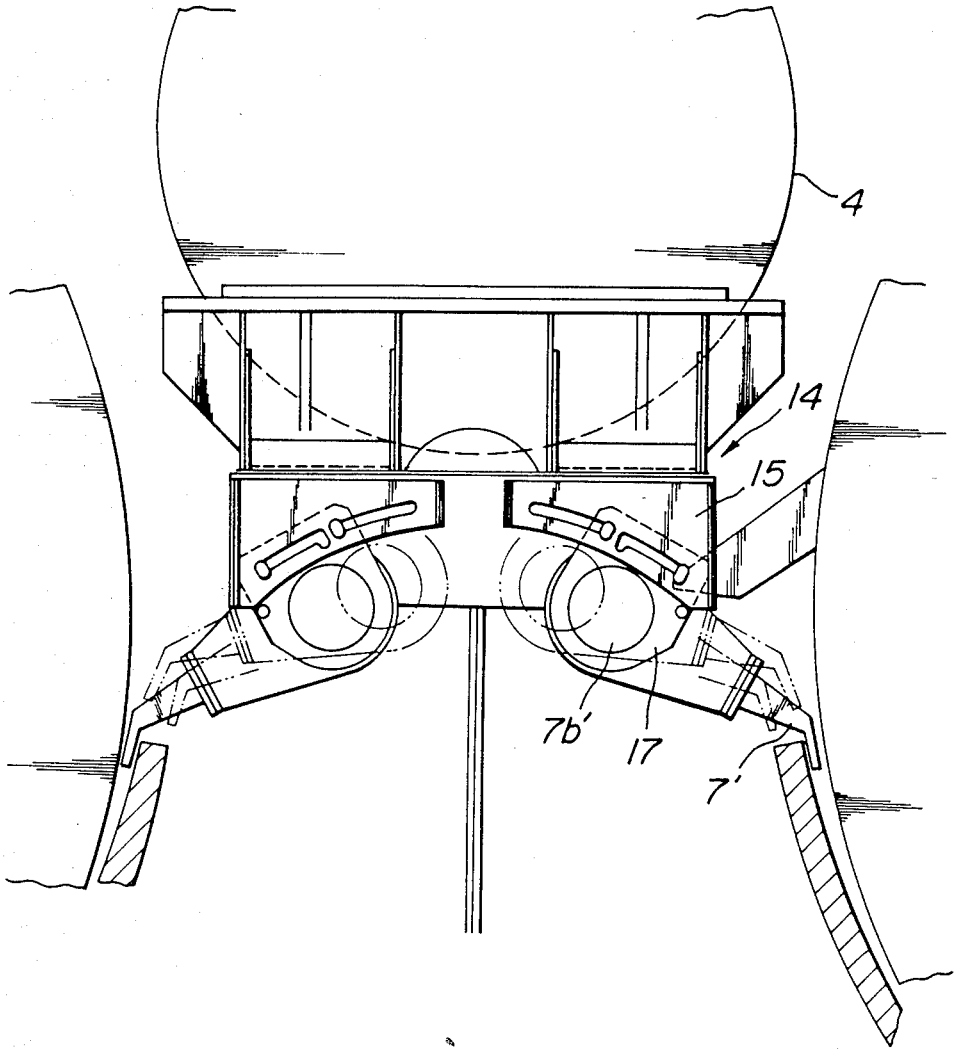
FIG. 12 is a view for explaining retraction of the top nozzles in a rear step plating bath as one embodiment of the invention.

In order to avoid such troublesome operation for the top nozzle 71, as shown in FIG. 12 partially illustrating an example of plating baths on downstream side, to an underside of a bearing stand 14 for an intermediate deflector roll 4 is secured a hanger bracket 15 whose web 15 is formed with elongated slots 16 as guide means along which supports 17 for carrying top nozzles 7' together with their headers 7*b'* are guided along the slots 16 so as to advance and retract. Either top nozzle on the right or left side as viewed in FIG. 12 is used according to the moving direction of the strip. The other nozzle not used is conveniently retracted into an inoperative position shown in phantom lines in FIG. 12.

Figure 13A:
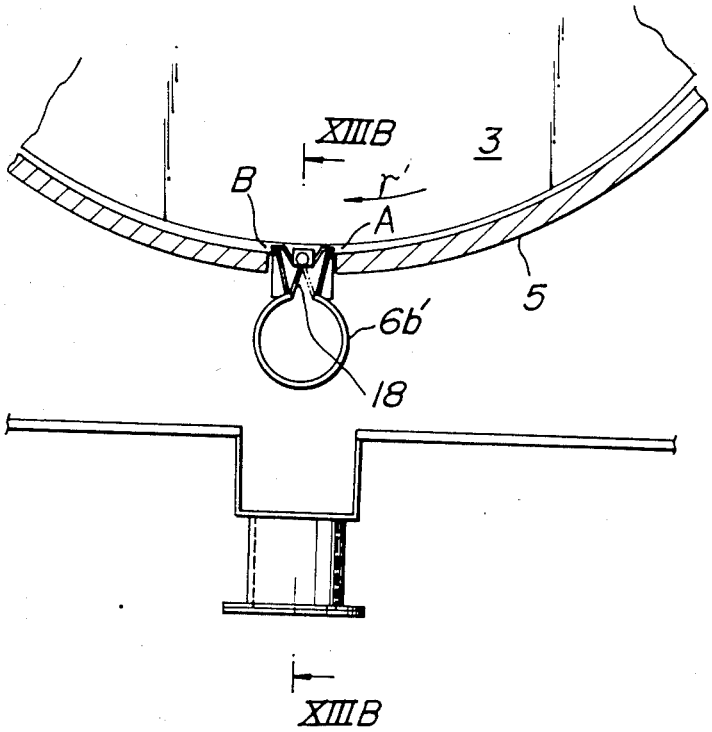
FIG. 13*a* is a sectional view of a bottom nozzle capable of changing its jetting direction according to the invention.
Figure 13B:
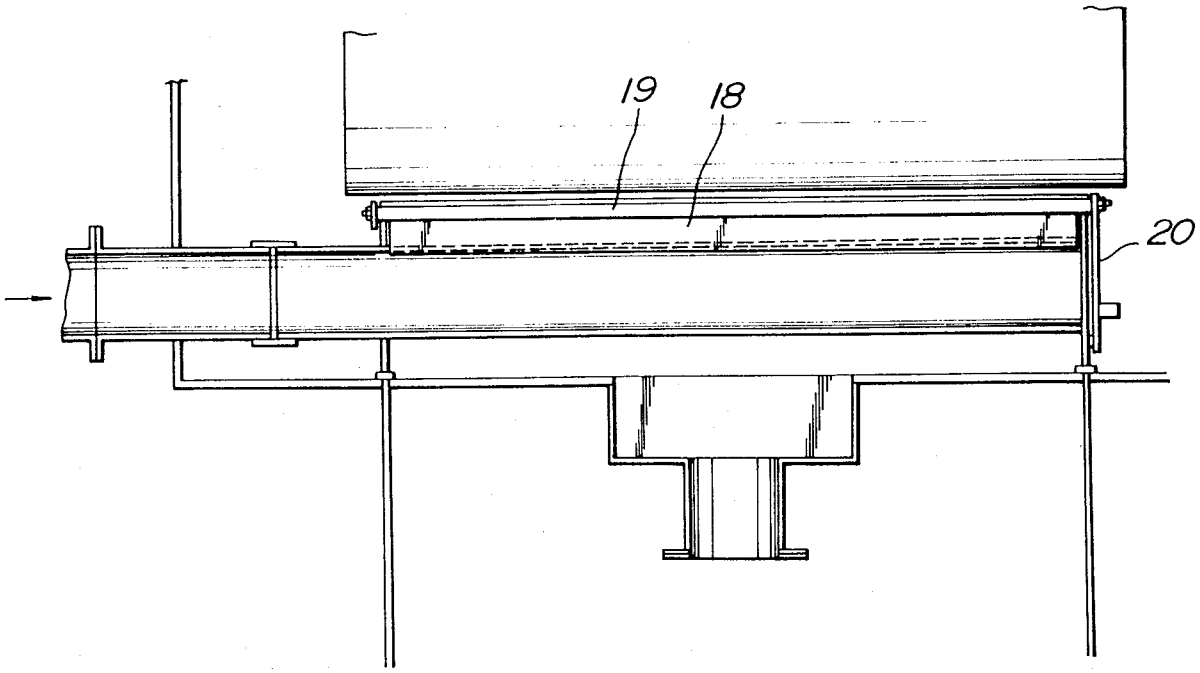
FIG. 13*b* is a sectional view taken along a line XIIIB—XIIIB in FIG. 13*a*.

For the bottom nozzle 6', as shown in FIGS. 13*a* and 13*b*, a header 6*b'* is provided with two nozzle openings A and B directing to the downpass and uppass, respectively, between which is hanged a pivotable flap 18 adapted to be selectively switched over between positions in solid and phantom lines, thereby easily reversing the jetting direction of the plating solution so as to deal with the problem. In FIG. 13*b*, a numeral 19 denotes a pivotal shaft for the flap 18 and a numeral 20 indicates a changing lever.

As can be seen from the above description, the counter flow device according to the invention comprises a bottom nozzle and a top nozzle properly arranged to cause uniform counter flows over entire gaps between a metallic strip and electrodes, thereby remarkably increasing critical current density in plating and advantageously realizing uniform plating in case of alloy plating.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A counter flow device for a plating apparatus including a rotary drum with its substantially half part immersed in a plating solution in a plating bath about said drum a metallic strip to be plated passing in synchronism with rotation of said rotary drum and anodes spaced apart by radial gaps from the strip for causing electric current to flow between said strip and the anodes, said device comprising a bottom nozzle arranged at a bottom of the bath and having a nozzle opening directing in a direction substantially opposite to an entering direction of said strip thereat and a top nozzle having a nozzle opening whose tip end is immersed in the proximity of a surface of said plating solution at a location where the strip leaves the plating solution.

2. A counter flow device as set forth in claim 1, wherein said top and bottom nozzles are capable of jetting from said openings a plating solution at a linear speed of 0.2 to 2 m/sec between said strip and the anodes.

3. A counter flow device as set forth in claim 1, wherein said top and bottom nozzles are arranged so as to permit their jetting direction of said plating solution to be inclined at an angle within 10° relative to tangents to said rotary drum thereat.

4. A counter flow device as set forth in claim 1, wherein an immersed depth of said tip end of said top nozzle in the plating solution is more than 15 mm from a surface of the plating solution in a quiescent state.

5. A counter flow device as set forth in claim 1, wherein overlapped lengths of said top and bottom nozzles with edges of said anodes in moving directions of said strip are less than 10 mm for said top nozzle and less than 2 mm for said bottom nozzle.

6. A counter flow device as set forth in claim 1, wherein said bottom nozzle comprises a duct and a header, which are divided by a partition into an upstream portion and a downstream portion, said downstream portion being formed along said moving direction of said strip with a suction port communicating with a return piping for exhausting the plating solution jetted from the top nozzle and flowed toward the bottom nozzle wihout mixing with a refreshed plating solution jetted from the bottom nozzle.

7. A counter flow device as set forth in claim 6, wherein said bottom nozzle is provided with a separator arranged at the top of said partition and between said upstream and downstream portions so as to be in close contact with said strip, and said separator being made of a soft material.

8. A counter flow device as set forth in claim 1, wherein in case of uniting two of said plating baths, to an underside of a bearing stand for a deflector roll above and between two rotary drums of the baths is fixed a hanger bracket whose web is formed with slots as guide means, along which supports for carrying said top nozzles together with their headers, respectively are moved toward and away from the respective rotary drums, thereby enabling either one top nozzle to be retracted into its inoperative position when it is not used in accordance with variation in moving direction of the strip.

9. A counter flow device as set forth in claim 1, wherein said bottom nozzle comprises two said nozzle openings directing in opposite directions and a pivotable flap hanged between said two nozzle openings and being selectively switched over to close either one of said two nozzle openings according to variation in moving direction of the strip.

* * * * *